US007350507B2

(12) United States Patent
Yahara

(10) Patent No.: US 7,350,507 B2
(45) Date of Patent: Apr. 1, 2008

(54) FUEL INJECTOR ASSEMBLY AND METHOD OF MOUNTING THE SAME

(75) Inventor: Nobuyuki Yahara, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 12 days.

(21) Appl. No.: 11/413,079

(22) Filed: Apr. 28, 2006

(65) Prior Publication Data

US 2006/0243254 A1 Nov. 2, 2006

(30) Foreign Application Priority Data

Apr. 28, 2005 (JP) ..... 2005-133714

(51) Int. Cl.
*F02M 61/14* (2006.01)

(52) U.S. Cl. ..... 123/470; 123/468

(58) Field of Classification Search ..... 123/468, 123/469, 470

See application file for complete search history.

(56) References Cited

U.S. PATENT DOCUMENTS 3,431,895 A * 3/1969 Bailey ..... 123/470
3,845,748 A * 11/1974 Eisenberg ..... 123/468
3,924,583 A * 12/1975 Jardin ..... 123/470
4,485,790 A * 12/1984 Nishimura et al. ..... 123/468
5,365,907 A * 11/1994 Dietrich et al. ..... 123/470
5,617,828 A * 4/1997 Kuegel et al. ..... 123/468
5,775,303 A * 7/1998 Sweetland et al. ..... 123/470
6,234,413 B1 5/2001 Greaney
6,279,540 B1 8/2001 Greaney

OTHER PUBLICATIONS

Chinese Office Action dated Nov. 2, 2007. (with translation)

* cited by examiner

*Primary Examiner*—Thomas Moulis
(74) *Attorney, Agent, or Firm*—Nixon & Vanderhye P.C.

(57) ABSTRACT

An injector assembly is disclosed for mounting within a mounting member, which includes a first mounting aperture that defines an axis, and a second mounting aperture that defines an axis and an inner surface. The axis of the first mounting aperture extends transverse to the axis of the second mounting aperture. The injector assembly includes an inlet connector that can be disposed within the first mounting aperture. The injector assembly further includes an injection valve member that can be disposed within the second mounting aperture. The injection valve member includes a fuel inlet that defines an axis. The injection valve member is in fluid communication with the inlet connector via the fuel inlet. Furthermore, the injector assembly includes an abutment member operable to supply a supporting force from the second mounting aperture to the injection valve member. The axis of the fuel inlet approximately intersects the abutment member.

22 Claims, 5 Drawing Sheets

FUEL INJECTOR ASSEMBLY AND METHOD OF MOUNTING THE SAME

CROSS-REFERENCE TO RELATED APPLICATION

This application is based on Japanese Patent Application No. 2005-133714 filed on Apr. 28, 2005, the disclosure of which is incorporated herein by reference.

TECHNICAL FIELD

The present invention relates generally to fuel injectors and, more particularly, relates to a fuel injector assembly and a method of mounting the fuel injector assembly.

BACKGROUND OF INVENTION

Many internal combustion engines include fuel injector assemblies. An injection pump pressurizes fuel, and the fuel injector assemblies inject the pressurized fuel into respective combustion chambers in the engine.

A typical fuel injector assembly includes an injection valve member having an injection nozzle at one end and an inlet connector supplying high-pressure fuel to the injection valve member. The injection valve member is generally cylindrical and has an axially uniform outer peripheral surface. The outer peripheral surface has a fuel inlet with a conical seat. The inlet connector, on the other hand, includes a fuel pipe and has a rounded joining surface at an outlet end.

The injection valve member is mounted in a mounting hole included in the engine cylinder head, and the inlet connector is mounted in a separate mounting hole. Once mounted, the axis of the inlet connector extends transversely to the axis of the injection valve member.

The inlet connector is coupled to the injection valve member by coupling the joining surface of the inlet connector to the fuel inlet of the injection valve member such that fuel can flow from the inlet connector, through the fuel inlet, and into the injection valve member.

More specifically, the inlet connector is laterally pressed into the valve body when interconnecting the inlet connector and the valve body. In so doing, a force directed transverse to the axis of the injection valve member is applied to the injection valve member. This transverse force can damage the fuel injector assembly by creating detrimental stress concentrations in the valve body.

Also, a relatively high force is typically needed for retaining the coupling of the inlet connector and the injection valve member. As a result, the valve body can be subjected to bending, which can damage the valve body. This problem is exacerbated as the fuel pressure is increased.

In partial response to this problem, U.S. Pat. No. 6,234,413 discloses an injector assembly with an injection valve member that is elliptical or polygonal in cross section. The injection valve member is mounted within a mounting hole having an inner surface that is circular in cross section. As such, the outer surface of the injection valve member abuts against the inner surface of the mounting hole at a plurality of "reaction points." As such, these reaction points support the valve body against a force directed from the inlet connector toward the injection valve member. However, as shown in FIG. 2 of the '413 patent, a clearance exists at a circumferential point that is opposite to the axis of the inlet connector. As such, an inlet force directed from the inlet connector 9 toward the injection valve member 2 will create a plurality of reactive forces at the reaction points; however, the reactive forces are not directed along the same line as the inlet force. Accordingly, the injection valve member may be detrimentally affected by stress concentrations.

This problem is explained with reference to FIGS. 7A and 7B, which are pattern diagrams of a nozzle sliding portion of a conventional injector assembly. As shown in FIG. 7A, the axis Y of the injection valve member 2 is straight when the injection valve member 2 is uncoupled from the inlet connector 9. The injection valve member 2 abuts against the inner surface of the mounting aperture 71 at an upper support point A and a lower support point B. As shown in FIG. 7B, when the injection valve member 2 is coupled with the inlet connector 9, a coupling force F is directed along the axis of the inlet connector 9 toward the injection valve member 2. Supporting forces F' result at the support points A, B. Because a moment arm exists between the coupling force F and the supporting forces F', the valve body 2 is subjected to a bending moment, which causes the axis Y' to curve. As such, the valve body 2 can be damaged due to bending.

SUMMARY OF THE INVENTION

In response to the aforementioned problems, an injector assembly is disclosed. The injector assembly is suitable for mounting within a mounting member, which includes a first mounting aperture that defines an axis, and further including a second mounting aperture that defines an axis and an inner surface. The axis of the first mounting aperture extends transverse to the axis of the second mounting aperture. The injector assembly includes an inlet connector that can be disposed within the first mounting aperture. The injector assembly further includes an injection valve member that can be disposed within the second mounting aperture. The injection valve member includes a fuel inlet that defines an axis. The injection valve member is in fluid communication with the inlet connector via the fuel inlet. Furthermore, the injector assembly includes an abutment member operable to supply a supporting force from the second mounting aperture to the injection valve member. The axis of the fuel inlet approximately intersects the abutment member.

In another aspect the present disclosure relates to an engine that includes a mounting member. The mounting member includes a first mounting aperture that defines an axis and a second mounting aperture that defines an axis and an inner surface. The axis of the first mounting aperture extends transverse to the axis of the second mounting aperture. The engine also includes an inlet connector disposed within the first mounting aperture. In addition, the engine includes an injection valve member disposed within the second mounting aperture. The injection valve member includes a fuel inlet that defines an axis, and the injection valve member is in fluid communication with the inlet connector via the fuel inlet. Furthermore, the engine includes an abutment member operable to supply a supporting force from the second mounting aperture to the injection valve member. The axis of the fuel inlet approximately intersects the abutment member.

In still another aspect the present disclosure relates to a method of mounting an injector assembly within an engine. The method includes the step of providing a mounting member including a first mounting aperture that defines an axis, and further including a second mounting aperture that defines an axis and an inner surface. The axis of the first mounting aperture extends transverse to the axis of the second mounting aperture. The method also includes mounting an inlet connector within the first mounting aperture and mounting an injection valve member within the second mounting aperture. The injection valve member includes a fuel inlet that defines an axis. The method further includes fluidly coupling the inlet connector and the injection valve member by applying a coupling force directed along the axis of the fuel inlet. In addition, the method includes providing an abutment member operable to supply a supporting force from the second mounting aperture to the injection valve member. The axis of the fuel inlet approximately intersects the abutment member, such that the supporting force is substantially aligned with and opposed to the coupling force.

BRIEF DESCRIPTION OF THE DRAWINGS

Other objects, features, and advantages of the present invention will become more apparent from the following detailed description made with reference to the accompanying drawings, in which like parts are designated by like reference numbers and in which.

DETAILED DESCRIPTION

Figure 1A:
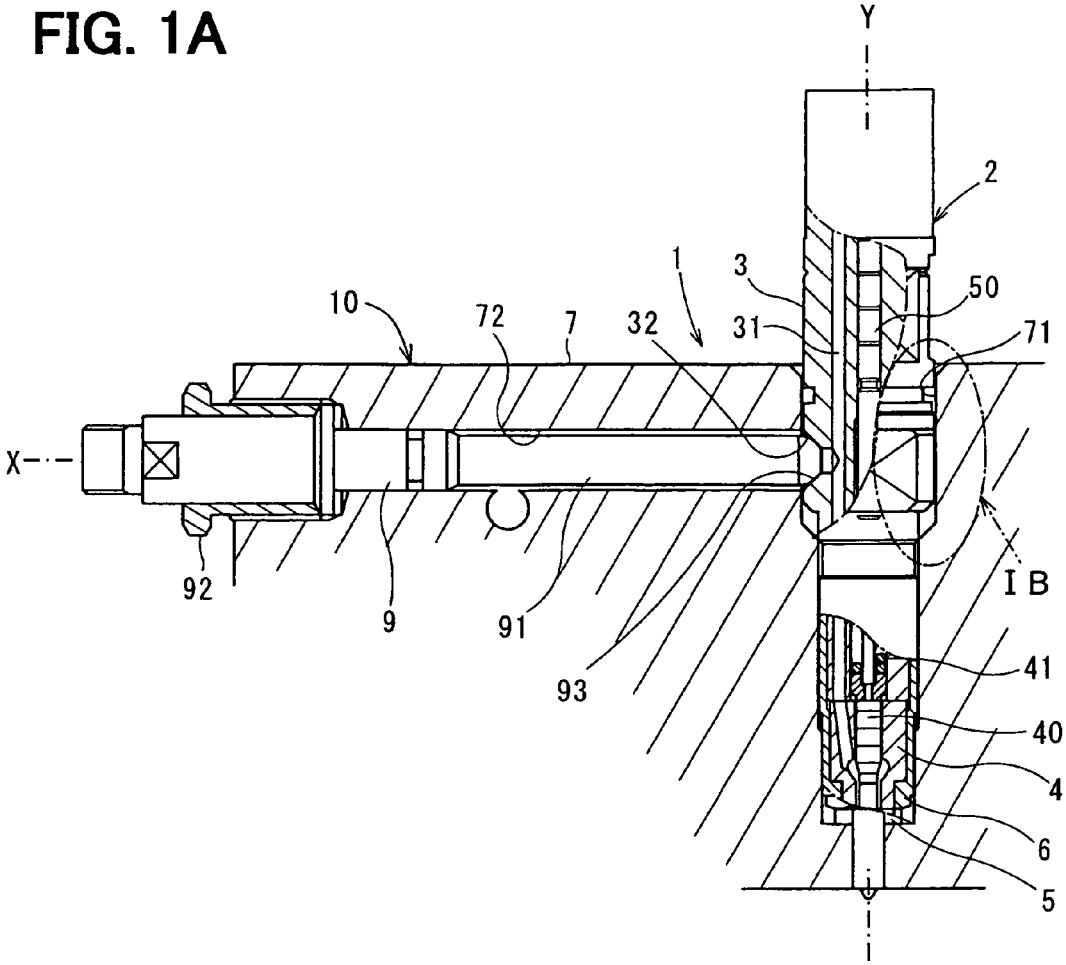
FIG. 1A is a cross sectional view of an injector assembly mounted in an engine.
Figure 1B:
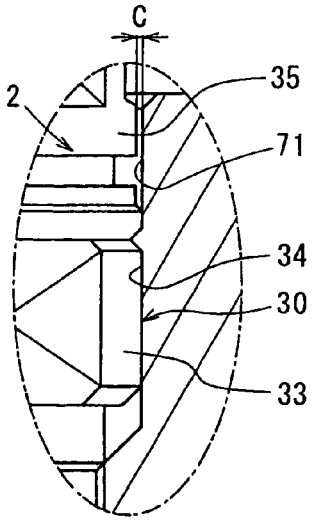
FIG. 1B is a detail view of the injector assembly of FIG. 1A.

Referring now to FIGS. 1A and 1B an injector assembly 1 is illustrated. The injector assembly 1 is mounted to a mounting member 7 of an engine 10. In one embodiment, the engine 10 is a diesel engine, and the injector assembly 1 is operable for intermittently injecting high-pressure fuel into a combustion chamber (not shown) of the engine 10. The injector assembly 1 generally includes an injection valve member 2 and an inlet connector 9. The inlet connector 9 supplies high-pressure fuel to the injection valve member 2, and the injection valve member 2 injects the fuel into the combustion chamber (not shown) of the engine 10.

In the embodiment shown, the injection valve member 2 includes a housing 3 that is generally cylindrical. A high-pressure fuel passage 31 is included within the housing 3 and extends parallel to the axis of the valve body 2. A fuel inlet 32 extends through an outer surface 30 of the housing 3 and is in fluid communication with the fuel passage 31. As shown, the fuel inlet 32 is conical in shape and has an axis that is perpendicular to the axis of the fuel passage 31.

The injection valve member 2 also includes a pressure pin 50 that is coaxial with the axis of the housing 3. Furthermore, a pressure controller (not shown) is included within the housing 3. The injection valve member 2 also includes a fuel injection nozzle 4 at one end. The nozzle 4 includes a needle valve 40. A tip of the needle valve 40 is in contact with an injection bore chamber (not shown) at one end, and an opposite end of the needle valve 40 is in contact with the pressure pin 50. The needle valve 40 is biased downward toward the combustion chamber by a spring 41. The nozzle 4 is coupled to the housing 3 by a retaining nut 6. A gasket 5 is also included on an outer surface of the nozzle 4 for maintaining an airtight seal.

In the embodiment shown, the inlet connector 9 generally includes an injection pipe 91 at one end and a fastening nut 92 at an opposite end. The injection pipe 91 is a cylindrical pipe with a fuel passage extending therethrough. The inlet connector 9 also includes a coupling member 93 at a terminal end of the injection pipe 91. The coupling member 93 is hemispherical in the embodiment shown and is fluidly coupled to the fuel inlet 32 of the injection valve member 2. As such, high pressure fuel within the injection pipe 91 is able to flow into the injection valve member 2 through the fuel inlet 32.

In operation, fuel is received into the injection valve member 2 via the fuel inlet 32, and the pressure controller causes the pressure pin 50 to slide upward and downward along the axis of the valve body 2 to thereby move fuel through the fuel passage 31, through the nozzle 4, and into the combustion chamber of the engine 10. It will be appreciated that the components, construction, operation, etc. of the injection valve member 2 and inlet connector 9 could vary in any suitable manner from the embodiment shown without departing from the scope of the present invention.

The mounting member 7 of the engine 10 further includes a mounting member 7. In one embodiment, the mounting member 7 is a cylinder head of an internal combustion engine. The mounting member 7 includes a first mounting aperture 72 and a second mounting aperture 71. In the embodiment shown, the first and second mounting apertures 71, 72 are each cylindrical. Also, an axis X of the first mounting aperture 72 extends transverse to the axis Y of the second mounting aperture 71. In the embodiment shown, the axis X is approximately perpendicular to the axis Y; however, the axis X could be disposed at any suitable angle to the axis Y. Furthermore, and the first mounting aperture 72 is in communication with the second mounting aperture 71.

The inlet connector 9 is disposed within the first mounting aperture 72, and the injection valve member 2 is disposed within the second mounting aperture 71. As such, the inlet connector 9 is substantially coaxial with the axis X of the second mounting aperture 71, and the injection valve member 2 is substantially coaxial with the axis Y of the first mounting aperture 72. Furthermore, the axis of the fuel inlet 32 is substantially coaxial with the axis X of the second mounting aperture 71.

The injection valve member 2 is inserted into the second mounting aperture 71 and a clamp (not shown) presses the injection valve member 2 along the axis Y to thereby fix the injection valve member 2 to the mounting member 7. Then, the fastening nut 92 of the inlet connector 9 is advanced such that the inlet connector 9 presses into the injection valve member 2 along the axis X until the coupling member 93 seals against the fuel inlet 32 of the injection valve member 2.

As shown in FIG. 1A, the outer surface 30 of the injection valve member 2 includes an abutment member 33. More specifically, the outer surface 30 of the injection valve member 2 is generally cylindrical at the abutment member 33 and has a diameter that allows abutment between the outer surface 30 and the inner surface 34 of the second mounting aperture 71. The abutment member 33 is axially disposed on the outer surface 30 of the injection valve member 2 such that the axis X and the axis of the fuel inlet 32 each approximately intersect the abutment member 33. As such, the abutment member 33 supports the injection valve member 2 against bending stresses when the inlet member 9 is coupled to the injection valve member 2 as will be discussed in greater detail below.

The outer surface 30 of the injection valve member 2 further includes a relief member 35 as shown in FIG. 1B. More specifically, the outer surface 30 is generally cylindrical at the relief member 35 and has a diameter that is significantly less than the diameter of the inner surface 34 of the second mounting aperture 71. Thus, the relief member 35 provides clearance C between the outer surface 30 of the injection valve member 2 and the inner surface 34 of the second mounting aperture 71. In the embodiment shown, the abutment member 33 is interposed between the nozzle 4 and the relief member 35 with respect to the axis Y.

In the embodiment shown, the relief member 35 is included in the housing 3 of the injection valve member 2. However, the position of the relief member 35 is not limited thereto and may be included in the injection nozzle 4. In addition, the relief member 35 may be provided in the housing 3 and the injection nozzle 4 of the injection valve member 2.

Also, in the embodiment shown, the abutment member 33 abuts against the inner surface 34 of the second mounting aperture 71 around the entire periphery of the injection valve member 2. However, it will be appreciated that the abutment member 33 could provide only localized abutment against the inner surface 34 opposite to the fuel inlet 32 (i.e., in the region shown in FIG. 1B). Likewise, in the embodiment shown, the relief member 35 is cylindrical. As such, the relief member 35 provides clearance around the entire periphery of the injection valve member 2. However, it will be appreciated that the relief member 35 could provide only localized clearance in an area opposite to the fuel inlet 32 (i.e., in the region shown in FIG. 1B).

Figure 2A:
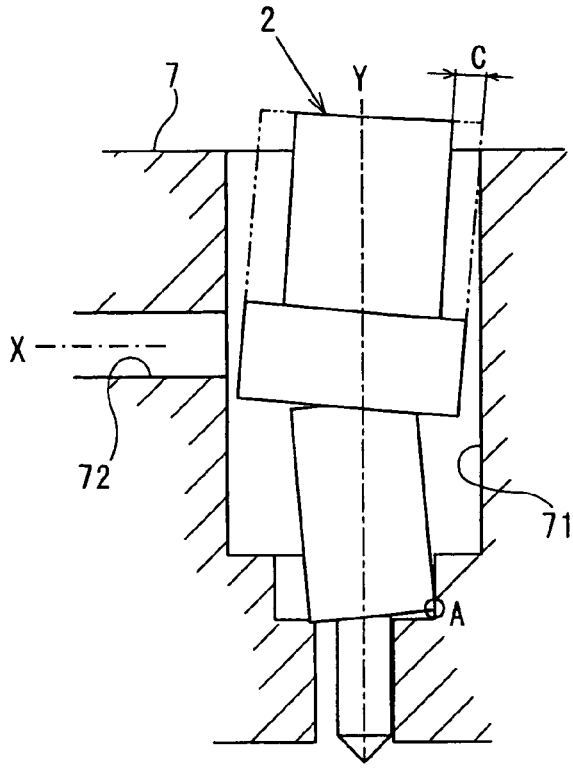
FIG. 2A is a pattern diagram showing deformation behavior of the injection valve member of FIG. 1A before mounting an inlet connector.
Figure 2B:
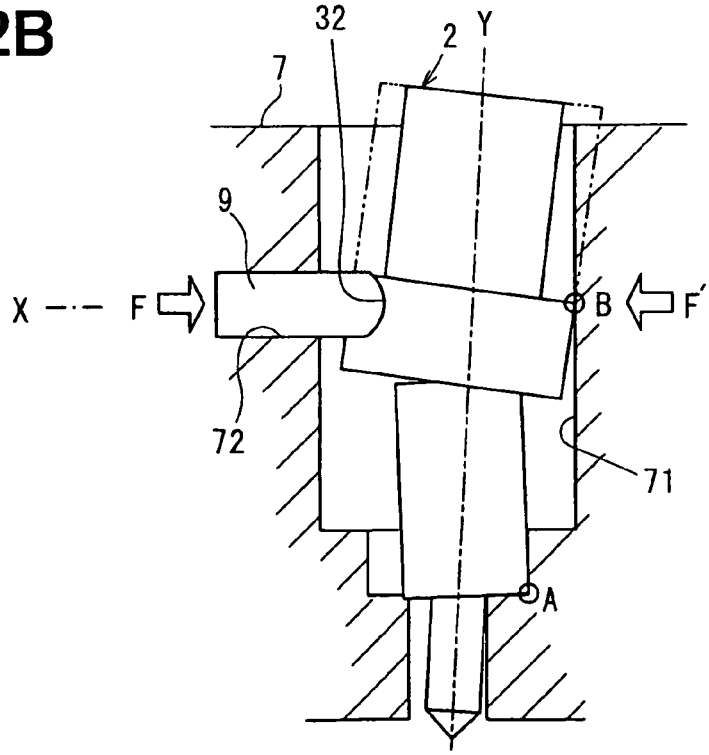
FIG. 2B is a pattern diagram showing deformation behavior of the injection valve member of FIG. 1A after mounting the inlet connector.

FIGS. 2A and 2B represent the forces involved when the injection valve member 2 and the inlet connector 9 are coupled. Before mounting the inlet connector 9 (FIG. 2A), the axis of the injection valve member 2 is straight and is coaxial with the axis Y of the second mounting hole 71.

When the inlet connector 9 is coupled to the injection valve member 2, a coupling force F is applied to the injection valve member 2 along the axis of the fuel inlet 32 (i.e., in a direction parallel to the axis X of the first mounting aperture 72). In the embodiment shown, the injection valve member 2 is supported at point A (i.e., adjacent the nozzle 4). However, support point A is an unfixed support point and supplies insubstantial support forces that oppose the coupling force F. The abutment member 33, on the other hand, provides a support force F' at support point B due to abutment with the inner surface 34 of the second mounting aperture 71. The support force F' is substantially aligned and opposed to the coupling force F. As such, the forces on the injection valve member 2 are largely balanced, and the injection valve member 2 is unlikely to deform due to bending.

In addition, the clearance C provided by the relief member 35 ensures that the support force F' acts substantially at support point B (i.e., opposite the fuel inlet 32). As such, the forces on the injection valve member 2 are largely balanced, and the injection valve member 2 is unlikely to deform due to bending. Accordingly, the injection valve member 2 is less likely to malfunction.

Furthermore, even if the axis of the injection valve member 2 is slightly slanted relative to the axis Y of the second mounting aperture 71, the clearance C provided by the relief member 35 ensures that the coupling force F will be aligned and opposed to the support force F'. As such, bending moments in the injection valve member 2 are unlikely to occur. In addition, an increased fuel pressure is unlikely to affect the injection valve member 2 detrimentally because the increased coupling force F will remain aligned and opposed to the support force F'.

Second Embodiment

Figure 3:
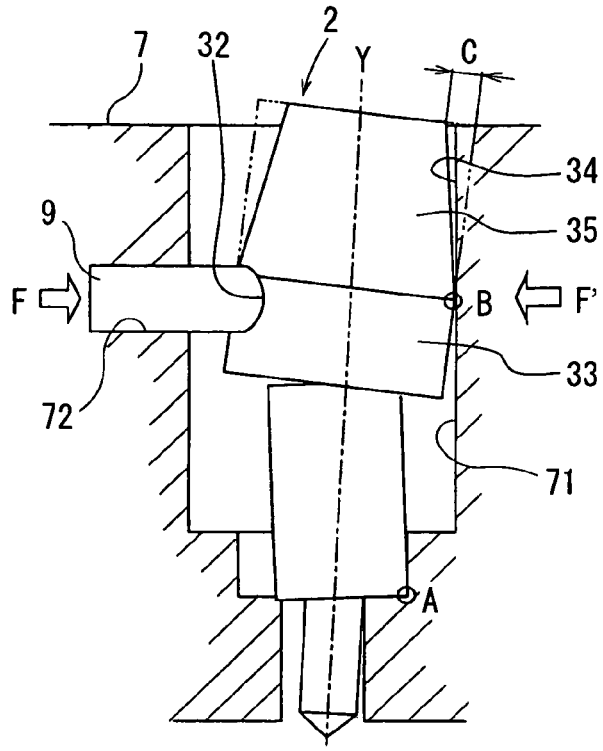
FIG. 3 is a pattern diagram showing deformation behavior of another embodiment of an injector assembly.

Referring now to FIG. 3, another embodiment of the injector assembly 1 is represented. In this embodiment, the housing 3 of the injection valve member 2 includes a relief member 35 that is frustoconical in shape. The housing 3 also includes an abutment member 33 that is cylindrical in shape. The abutment member 33 is interposed between the relief member 35 and the nozzle 4 with respect to the axis Y. Also, the relief member 35 is tapered such that the cross sectional area of the relief member 35 is largest where the relief member 35 is coupled to the abutment member 33.

As such, the frustoconical relief member 35 provides clearance C between the injection valve member 2 and the inner surface 34 of the second mounting aperture 71. Also, the abutment member 33 abuts against the inner surface 34 in a circumferential location opposite the inlet connector 9. Thus, the coupling force F is aligned and opposed to the support force F'. Accordingly, the injection valve member 2 is unlikely to be subjected to stress concentrations due to bending, and the injection valve member 2 is less likely to be damaged due to bending.

Third Embodiment

Figure 4:
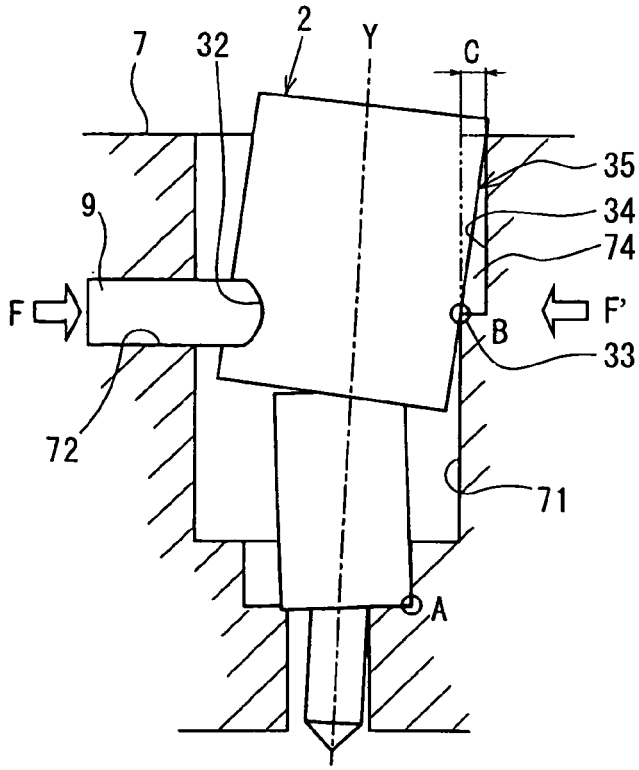
FIG. 4 is a pattern diagram showing deformation behavior of another embodiment of an injector assembly.

Referring now to FIG. 4, another embodiment of the injector assembly 1 is represented. In the embodiment shown, the inner surface 34 of the second mounting aperture 71 is stepped so as to define a recess 74 therein. It will be appreciated that the recess 74 acts as the relief member 35 described above. Accordingly, the recess 74 provides clearance between the injection valve member 2 and the inner surface 34 of the second mounting aperture 71. Also, the abutment member 33 is disposed at the terminal end of the recess 74 (i.e., at support point B in FIG. 4).

In order to form the recess 74, one or more cutting tools (not shown) are used to remove material from the mounting member 7. It will be appreciated that the recess 74 could be formed in any suitable manner.

For instance, a boring tool is used to create a bore extending to a predetermined depth in the mounting member 7. Then, a milling tool is used for milling in a direction transverse to the axis Y and away from the first mounting aperture 72 to thereby create the recess 74.

In another embodiment, a first boring tool is used to bore material from the mounting member 7 along the axis Y. Then, material is bored from the mounting member 7 along the axis Y with a second boring tool having a larger diameter than the first boring tool, and the second boring tool cuts to a shallower depth. As such, the recess 74 is formed by the second boring tool.

In still another embodiment, the recess 74 is frustoconical in shape. To form the frustoconical recess 74, a first boring tool removes material from the mounting member 7 along the axis Y to a predetermined depth. Then, a cutting tool with a frustoconical shape is used to remove material from the bore to thereby form the recess 74.

It will be appreciated that the depth of the recess 74 can be set at relatively tight tolerances using these manufacturing methods. As such, the location of the abutment member 33 can be very accurate. Accordingly, the supporting force F' is more likely to be aligned and opposed to the coupling force F, and the injection valve member 2 is less likely to be damaged due to bending.

Fourth Embodiment

Figure 5:
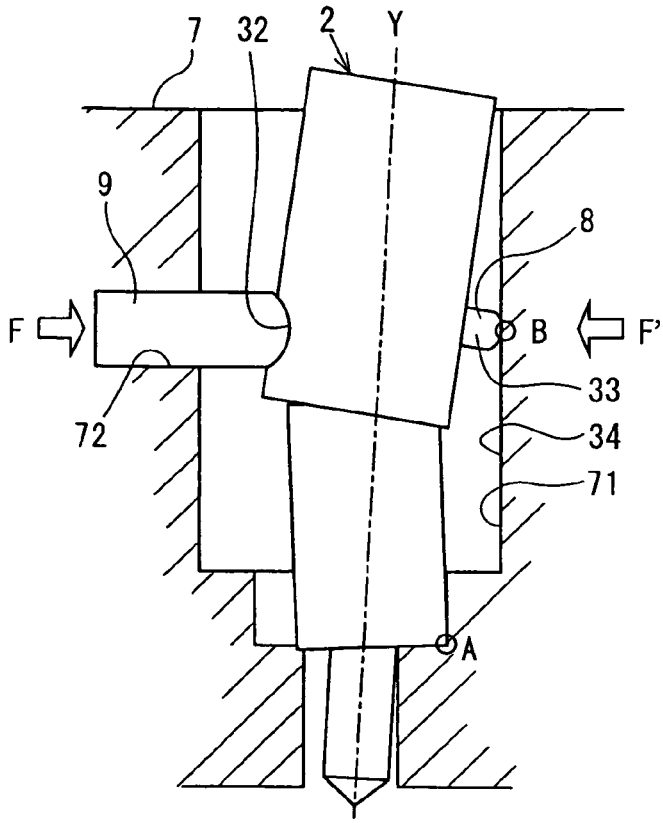
FIG. 5 is a pattern diagram showing deformation behavior of another embodiment of an injector assembly.
Figure 6:
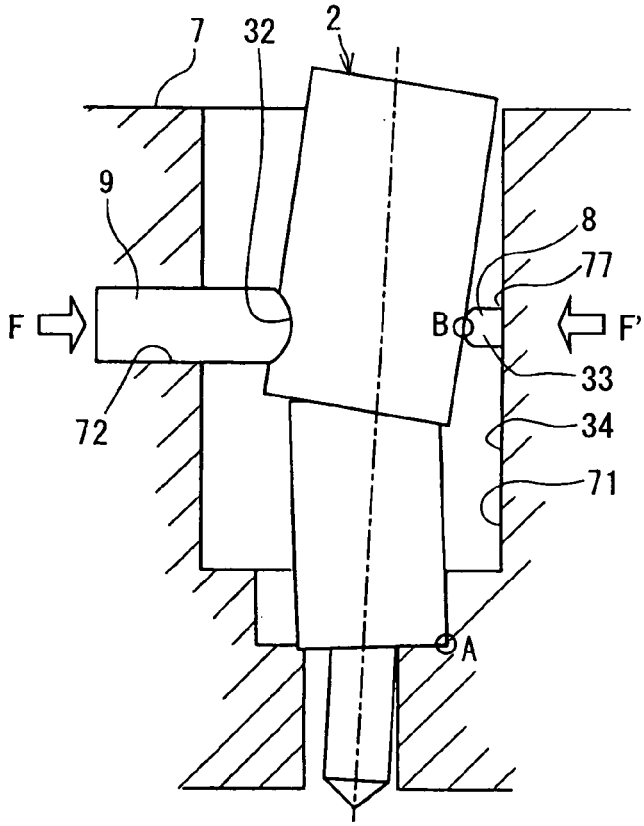
FIG. 6 is a pattern diagram showing deformation behavior of another embodiment of an injector assembly.
Figure 7A:
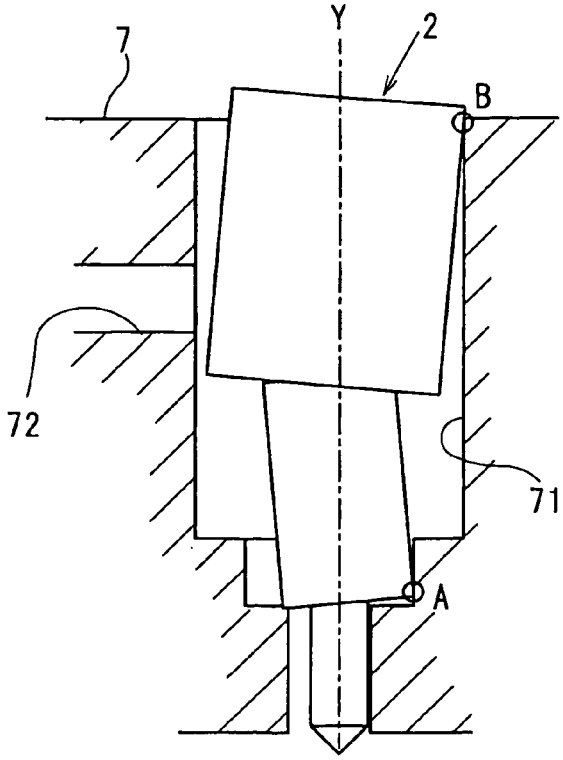
FIG. 7A PRIOR ART
FIG. 7A is a pattern diagram showing deformation behavior of a injector valve body of the prior art shown before coupling the inlet connector.
Figure 7B:
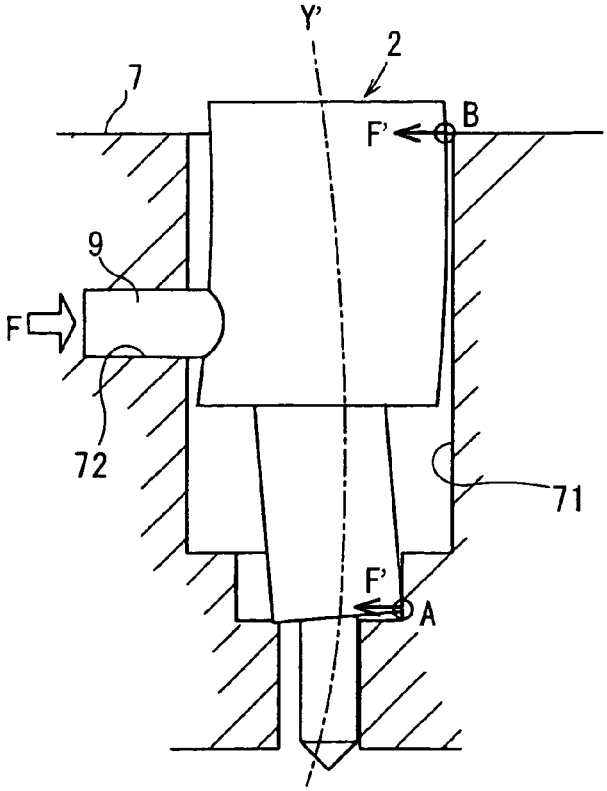
FIG. 7B PRIOR ART
FIG. 7B is a pattern diagram showing deformation behavior of the injector valve body of FIG. 7A shown after coupling the inlet connector.

Referring now to FIGS. 5 and 6, another embodiment of the injection assembly 1 is illustrated. As shown, the abutment member is a projection 8 that is coupled either to the injection valve member 2 (FIG. 5) or to the inner surface 34 of the second mounting aperture 71 (FIG. 6).

Specifically, in FIG. 5, the projection 8 is coupled at one end to the injection valve member 2. The projection 8 can be integrally connected or removably connected to the injection valve member 2. An opposite end of the projection 8 is rounded (i.e., there are no flat surfaces). As such, the rounded end of the projection 8 is more likely to transfer the supporting force F' at a point of intersection with the axis of the fuel inlet 32. In other words, if the injection assembly 1 is manufactured outside of tolerances, the rounded end of the projection 8 is likely to account for any misalignment such that the supporting force F' is aligned and opposed to the coupling force F. Accordingly, the injection valve member 2 is less likely to be damaged due to bending.

Furthermore, in FIG. 6, the projection 8 is coupled at one end to the inner surface 34 of the second mounting aperture 71. The projection 8 can be integrally connected or removably connected to the inner surface 34. In one embodiment, cutting tools (not shown) are used to form the first and second mounting apertures 71, 72. Then, a cutting tool is extended through the first mounting aperture 72 to remove material from the inner surface 34 and to thereby form an abutment aperture 77. Next, the projection 8 is coupled to the mounting member 7 via the abutment aperture 77.

The projection 8 is rounded at one end similar to the embodiment shown in FIG. 5. As such, the rounded end of the projection 8 is more likely to transfer the supporting force F' at a point of intersection with the axis of the fuel inlet 32. In other words, if the injection assembly 1 is manufactured outside of tolerances, the rounded end of the projection 8 is likely to account for any misalignment such that the supporting force F' is aligned and opposed to the coupling force F. Accordingly, the injection valve member 2 is less likely to be damaged due to bending.

In each of the above-mentioned embodiments, the injector assembly 1 is used for an accumulator fuel injection apparatus. However, it will be appreciated that the injector assembly 1 may be incorporated in any suitable system, such as a jerk fuel injection apparatus or a fuel injection apparatus for a gasoline engine.

While only the selected embodiments have been chosen to illustrate the present invention, it will be apparent to those skilled in the art that various changes and modifications can be made therein without departing from the scope of the invention as defined in the appended claims. Furthermore, the foregoing description of the embodiments according to the present invention is provided for illustration only, and not for the purpose of limiting the invention as defined by the appended claims and their equivalents.

What is claimed is:

1. An injector assembly for mounting within a mounting member, the mounting member including a first mounting aperture that defines an axis, and further including a second mounting aperture that defines an axis and an inner surface, wherein the axis of the first mounting aperture extends transverse to the axis of the second mounting aperture, the injector assembly comprising:

an inlet connector that can be disposed within the first mounting aperture;

an injection valve member that can be disposed within the second mounting aperture, the injection valve member including a fuel inlet that defines an axis, and wherein the injection valve member is in fluid communication with the inlet connector via the fuel inlet; and an abutment member operable to supply a supporting force from the second mounting aperture to the injection valve member, wherein the axis of the fuel inlet approximately intersects the abutment member.

2. The injector assembly of claim 1:

wherein the injection valve member includes an outer surface that includes the abutment member and a relief member, and wherein the relief member provides clearance between the outer surface and the inner surface of the second mounting aperture.

3. The injector assembly of claim 2:

wherein the injection valve member includes a nozzle, and wherein the abutment member is interposed between the nozzle and the relief member with respect to the axis of the second mounting aperture.

4. The injector assembly of claim 2, wherein the relief member is cylindrical and has a diameter that is less than a diameter of the second mounting aperture.

5. The injector assembly of claim 2, wherein the relief member is frustoconical.

6. The injector assembly of claim 1, wherein the abutment member is a projection coupled to one of the injection valve member and the inner surface of the second mounting aperture.

7. The injector assembly of claim 6, wherein the projection includes a rounded end.

8. An engine comprising:

a mounting member including a first mounting aperture that defines an axis, and a second mounting aperture that defines an axis and an inner surface, wherein the axis of the first mounting aperture extends transverse to the axis of the second mounting aperture;

an inlet connector disposed within the first mounting aperture;

an injection valve member disposed within the second mounting aperture, the injection valve member including a fuel inlet that defines an axis, and wherein the injection valve member is in fluid communication with the inlet connector via the fuel inlet; and an abutment member operable to supply a supporting force from the second mounting aperture to the injection valve member, wherein the axis of the fuel inlet approximately intersects the abutment member.

9. The engine of claim 8:

wherein the injection valve member includes an outer surface that includes the abutment member and a relief member, and wherein the relief member provides clearance between the outer surface and the inner surface of the second mounting aperture.

10. The engine of claim 9:

wherein the injection valve member includes a nozzle, and wherein the abutment member is interposed between the nozzle and the relief member with respect to the axis of the second mounting aperture.

11. The engine of claim 9, wherein the relief member is cylindrical and has a diameter that is less than a diameter of the second mounting aperture.

12. The engine of claim 9, wherein the relief member is frustoconical.

13. The engine of claim 8, wherein the mounting member includes a recess that provides clearance between an outer surface of the injection valve member and the inner surface of the second mounting aperture.

14. The engine of claim 8, wherein the abutment member is a projection coupled to one of the injection valve member and the inner surface of the second mounting aperture.

15. The engine of claim 14, wherein the projection includes a rounded end.

16. A method of mounting an injector assembly within an engine, the method comprising the steps of:

providing a mounting member including a first mounting aperture that defines an axis, and further including a second mounting aperture that defines an axis and an inner surface, wherein the axis of the first mounting aperture extends transverse to the axis of the second mounting aperture;

mounting an inlet connector within the first mounting aperture;

mounting an injection valve member within the second mounting aperture, the injection valve member including a fuel inlet that defines an axis;

fluidly coupling the inlet connector and the injection valve member by applying a coupling force directed along the axis of the fuel inlet; and providing an abutment member operable to supply a supporting force from the second mounting aperture to the injection valve member, wherein the axis of the fuel inlet approximately intersects the abutment member, such that the supporting force is substantially aligned with and opposed to the coupling force.

17. The method of claim 16, further comprising the step of providing the injection valve member with an outer surface that includes the abutment member and a relief member, wherein the relief member provides clearance between the outer surface and the inner surface of the second mounting aperture.

18. The method of claim 17, wherein the step of providing the injection valve member comprises providing a nozzle included on the injection valve member such that the abutment member is interposed between the nozzle and the relief member with respect to the axis of the second mounting aperture.

19. The method of claim 17, wherein the relief member is cylindrical and has a diameter that is less than a diameter of the second mounting aperture.

20. The method of claim 17, wherein the relief member is frustoconical.

21. The method of claim 16, wherein the step of providing the mounting member comprises removing material along the axis of the second mounting aperture to thereby define a relief member in the inner surface of the second mounting aperture, wherein the relief member provides clearance between the injection valve member and the inner surface of the second mounting aperture.

22. The method of claim 16, wherein the step of providing the abutment member comprises the steps of:

extending a cutting tool through the first mounting aperture and removing material from the inner surface of the second mounting aperture to thereby form an abutment aperture; and coupling the abutment member to the abutment aperture, wherein the abutment member is a projection that extends toward the injection valve member.

* * * * *